United States Patent [19]

Vontell et al.

[11] Patent Number: 4,680,199

[45] Date of Patent: Jul. 14, 1987

[54] METHOD FOR DEPOSITING A LAYER OF ABRASIVE MATERIAL ON A SUBSTRATE

[75] Inventors: John H. Vontell, Manchester; Roscoe A. Pike, Granby, both of Conn.

[73] Assignee: United Technologies Corporation, Hartford, Conn.

[21] Appl. No.: 842,591

[22] Filed: Mar. 21, 1986

[51] Int. Cl.[4] ..... B05D 1/12

[52] U.S. Cl. ..... 427/199; 427/204; 427/205; 427/226; 118/50

[58] Field of Search ..... 118/50; 427/199, 204, 427/205, 226

[56] References Cited

U.S. PATENT DOCUMENTS

| | | | |
|---|---|---|---|
| 389,485 | 9/1888 | Russell | 118/31 |
| 3,002,849 | 10/1961 | Harmon et al. | 117/21 |
| 3,049,810 | 8/1962 | Iwerks | 34/151 |
| 3,102,043 | 8/1963 | Winthrop et al. | 117/21 |
| 3,245,341 | 4/1966 | Childress et al. | 101/122 |
| 3,340,084 | 9/1967 | Eisenlohr | 117/22 |
| 3,571,839 | 3/1971 | Hartmann et al. | 15/303 |
| 3,617,327 | 11/1971 | Daniel | 117/18 |
| 3,958,039 | 5/1976 | Yabuki et al. | 427/195 X |
| 4,227,703 | 10/1980 | Stalker et al. | 277/53 |

*Primary Examiner*—Shrive P. Beck

*Attorney, Agent, or Firm*—James M. Rashid

[57] ABSTRACT

Techniques are described for the formation of an abrasive surface layer on an article. The surface layer is characterized by a single layer of particles which are evenly spaced apart, in a high density arrangement, within a metallic matrix. In the deposition of the particles on the article, a vacuum is drawn through a perforated plate, wherein the location of each perforation corresponds to the desired location of one particle on the article surface. The vacuum holds one particle over each perforation in the plate, then the plate is positioned over the article and the vacuum level adjusted so that the particles fall onto the article. The matrix is then deposited by plasma arc spraying a superalloy powder. The invention is particularly suited to the formation of an abrasive layer on the tip surface of a blade used in a gas turbine engine.

7 Claims, 10 Drawing Figures

FIG. 1
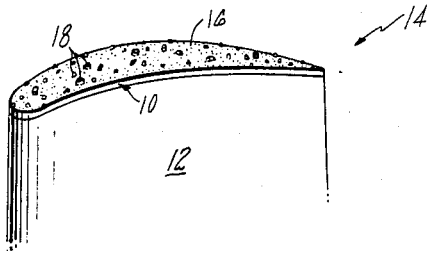
FIG. 2 PRIOR ART
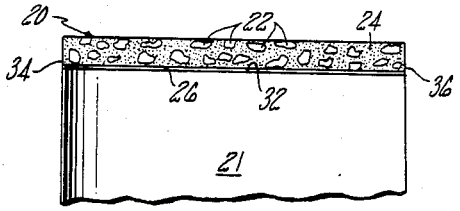
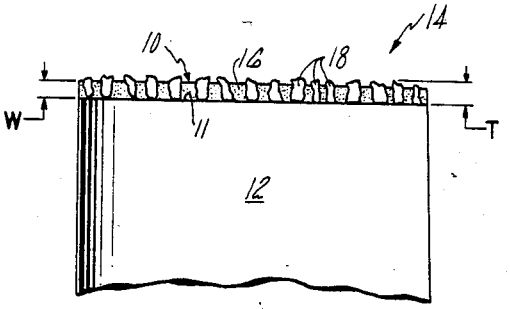
FIG. 3

FIG. 4
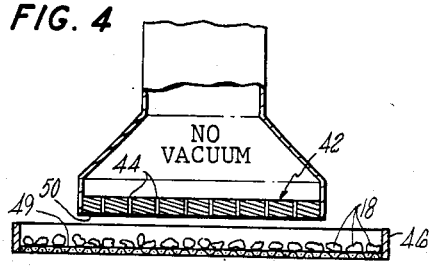
FIG. 5
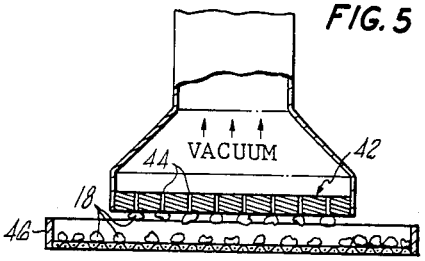
FIG. 6
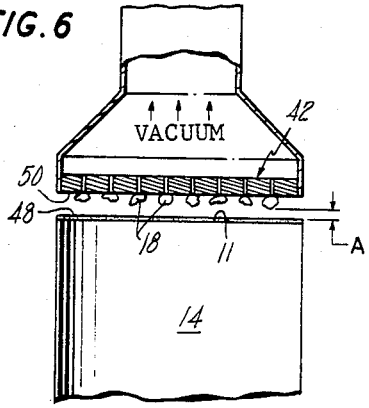
FIG. 7
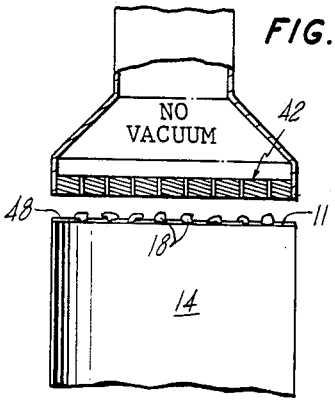
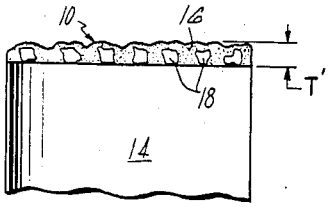
FIG. 9
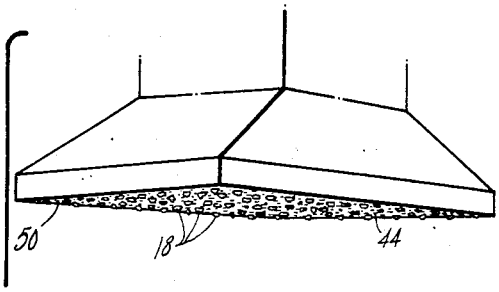
FIG. 8
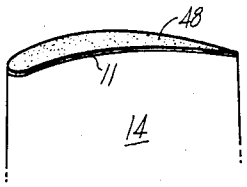
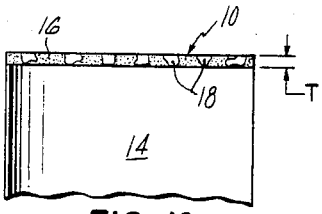
FIG. 10

METHOD FOR DEPOSITING A LAYER OF ABRASIVE MATERIAL ON A SUBSTRATE

CROSS REFERENCE

This invention is related to the copending and commonly assigned U.S. Pat. No. 4,610,698.

TECHNICAL FIELD

The present invention relates to a method for depositing particulate material on a substrate. More specifically, it relates to a method for depositing a surface layer containing spaced apart abrasive particulate on the tip surface of a turbine engine component.

BACKGROUND

Gas turbine engines and other turbomachines have rows of rotating blades contained within a generally cylindrical case. As the blades rotate, their tips move in close proximity to the case. To maximize engine operating efficiency, the leakage of the gas or other working fluid around the blade tips should be minimized. As has been known for some time, this may be achieved by blade and sealing systems in which the blade tips rub against a seal attached to the interior of the engine case. Generally, the blade tip is made to be harder and more abrasive than the seal; thus, the blade tips will cut into the seal during those portions of the engine operating cycle when they come into contact with each other.

One type of blade tip is described in U.S. Pat. No. 4,249,913 to Johnson et al, entitled "Alumina Coated Silicon Carbide Abrasive", of common ownership herewith. In the Johnson et al invention, silicon carbide abrasive particles of 0.20–0.76 mm average diameter are coated with a metal oxide such as alumina and incorporated by powder metal techniques in nickel or cobalt base matrix alloys. A powder metal compact containing up to about 45 volume percent particulate may be made which is then bonded to the tip of the blade. The resulting abrasive blade tip is particularly well suited for rubbing metal as well as ceramic airseals; the latter type of seals have found wide use in modern gas turbine engines.

As described in greater detail in the copending and commonly assigned U.S. Pat. No. 4,610,698, which is incorporated by reference, improved techniques for the fabrication of blade tips, relative to the type of methods described in Johnson et al, are desired. Specifically, the blade tip should be as thin as possible, yet still provide the required abrasive characteristics. The quantity of abrasive silicon carbide should be minimized, due to its high expense.

Components having thin layers of abrasive particles which are randomly distributed in a matrix material are known. For example, coated abrasives made from alumina, silica and silicon carbide are common products, as are metal bonded diamond and cubic boron nitride grinding tools. Such tools are often made by electrodeposition techniques. In U.S. Pat. No. 4,227,703, such techniques are used to deposit an abrasive layer on a turbine blade tip. However, the limited composition of electrodeposited matrix alloys limits the usefulness of this method. Sprayed deposits containing metal and ceramic abrasives are also well known. See, e.g., commonly assigned U.S. Pat. No. 4,386,112. However, such processes for spraying abrasive and matrix metal particles are inherently inefficient in that only a fraction of the sprayed material actually hits and adheres to the surface. These difficulties are especially significant in light of the relatively small size, e.g., about 6 by 50 mm, and curved shape of a typical turbine blade tip.

When an abrasive layer is provided on a superalloy turbine blade tip, its method of application must be metallurgically compatible with obtaining or maintaining the desired properties of the superalloy substrate. Since turbine blade alloys reflect a highly refined metallurgical art, there are limits on the techniques used with abrasive layer fabrication. Also, the abrasive layer is not a structural material and its weight imposes stresses on the blade substrate during use, i.e., when the blade rotates at high speed. Thus it is highly desirable that the minimum thickness abrasive layer be applied. Since blades are finished to length tolerances of 0.05 mm or less, this means that both the preparation of the substrate and the application of the abrasive layer must be carried out with high precision. All these considerations place severe restraints on the kinds of materials and processing techniques which are useful.

DISCLOSURE OF THE INVENTION

An object of the invention is a method for providing a single layer of spaced apart particles on the surface of an article. Another object of the invention is to deposit such particles in a high concentration and uniform distribution on a turbine blade tip. Yet another object of the invention is to provide an abrasive layer having high temperature operating capability on the tip surface of a turbine blade.

According to the invention, a method for depositing a single layer of particles in a desired pattern on the surface of an article comprises the steps of (a) drawing a vacuum through a transfer tool having a plurality of apertures arranged in said desired pattern, the size of each aperture being such that the vacuum holds only one particle in overlying relation to each aperture; (b) positioning the tool and the particles held thereto over the article surface; and (c) decreasing the vacuum level such that the particles fall onto the surface, their position on the surface substantially corresponding with the position of the apertures. Preferably, a layer of adhesive is present on the surface so that when the particles drop onto it, they are adhesively attached to the surface. Most preferably, the particles have a metal cladding thereon, and the article is then heated to volatilize the adhesive and sinter bond the clad particles to the surface.

The invention is particularly useful in the fabrication of an abrasive layer on the tip surface of a rotor blade used in a gas turbine engine. For desired operating characteristics, the particle density per unit area of blade tip surface must be maximized, while at the same time the interparticle contact must be minimized. Also, the particles must be securely bonded to the blade tip to withstand the stresses of engine operation. To fabricate such an abrasive layer on a blade tip, after the metal clad particles are sinter bonded to the tip surface, a matrix alloy material is deposited on the surface so as to cover the particles and to fill in the spaces between the particles. The particulate bearing matrix is then simultaneously heated and pressed to eliminate any voids in the matrix material and securely bond the matrix to the substrate and, by interdiffusion, to the cladding on each particle. The abrasive layer is then machined to a relatively flat surface, and then part of the matrix is chemically removed to cause portions of the particles to project into space. When blades having such an abrasive layer are installed in an engine, these exposed particles will rub the seal during engine operation, and minimize the leakage of working fluids around the blade tips, thus improving engine operating efficiency.

The abrasive particles are particularly sized with respect to the matrix layer thickness. Control over the particle sizing and aspect ratio are necessary to insure that a portion of most of the particles projects into space, while at the same time, all of the particles are securely bonded to the blade tip surface. Particles sized between Nos. 35–40 U.S. Sieve Series (0.42–0.50 mm nominal openings) are used when the matrix layer thickness is about 0.38 mm. Most preferably, the particles are uniformly spaced apart in a regular pattern on the blade tip surface. Depending on the expected interaction between the abrasive layer and the seal during engine operation, the particle density may be varied between about 35 to 110 particles per $cm^2$. This relatively close spacing necessitates using particles with aspect ratios less than 1.9 to 1, so that less than about 15% of the particles will contact one another after they are bonded to the tip surface.

The abrasive layer produced according to the invention is economical in the use of materials and has good durability when interacting with ceramic seals.

The foregoing and other objects, features and advantages of the present invention will become more apparent from the following description of preferred embodiments and accompanying drawings.

BRIEF DESCRIPTION OF THE DRAWINGS

FIG. 1 generally shows the radially outer portion of a typical gas turbine blade having an abrasive layer made according to the invention;

FIG. 2 shows in side view the appearance of a prior art abrasive layer;

FIG. 3 shows in side view the appearance of an abrasive layer produced according to the teachings of the present invention;

FIGS. 4–7 show simplified, schematic views of the method by which abrasive particles are placed on the surface of a turbine blade tip according to the present invention;

FIG. 8 shows a perspective view of FIG. 6;

FIG. 9 shows in side view the appearance of the abrasive particles enveloped in a matrix material; and FIG. 10 shows the abrasive layer machined to a flat surface.

BEST MODE FOR CARRYING OUT THE INVENTION

In an example of the practice of the invention, and referring to FIGS. 1 and 3, an abrasive layer 10 is formed on the tip surface 11 of the airfoil portion 12 of a gas turbine blade 14. The blade 14 is preferably made of a nickel base superalloy (such as the single crystal alloy of U.S. Pat. No. 4,209,348), while the abrasive layer 10 is comprised of a nickel base superalloy matrix 16 and alumina coated silicon carbide particles 18. As will be evident, other materials may be used in the practice of the invention.

The abrasive layer 10 is subjected to very high stresses during engine operation, and therefore it is important that the layer 10 have a certain configuration and properties to perform its function. In particular, the particles 18 must be disposed on the tip surface 11 in a certain manner to obtain optimum performance.

In a prior art abrasive layer 20 for a turbine blade 21 shown in FIG. 2, there are randomly disposed abrasive particles 22 within a matrix metal 24. A braze type bond joint 26, such as described in U.S. Pat. No. 3,678,570, holds the layer 20 on the blade tip 32. In such a prior art abrasive layer 20, there sometimes tends to be a lack of particles 22 at the blade leading and trailing edges, 34, 36, respectively. Some of the particles 22 touch each other, which results in the inefficient use thereof.

Referring to FIGS. 1 and 3, the abrasive layer 10 made according to the invention is characterized by a single layer of abrasive particles 18 surrounded by matrix material 16. Use of a single layer of abrasives 18 minimizes the mass of the entire layer 10, thus reducing the centripetal force on the blade 14 as it rotates during engine operation. The matrix metal 16 has a thickness W less than the overall thickness T of the particles 18. As a result, a portion of each particle 18 projects into space, thereby enabling favorable rubbing interaction with metal or ceramic seals during engine operation. For optimum performance, the unexposed portion of the particles 18 must be surrounded by matrix metal 16, and the particles 18 must be closely spaced apart from each other. Further, the matrix metal 16 as well as particles 18 must be securely bonded to the blade tip 11. In the invention, at least about 80–90% of the particulate surface area (excluding that surface area exposed at the blade tip) is surrounded by matrix metal 16 rather than being in contact with another particle 18. Also, the particles 18 are, in general, evenly and densely spaced on the blade tip 11. Densities of about 35–110 particles per $cm^2$ of tip surface 11 are obtained with the invention method of application, with about 50 particulates per $cm^2$ being preferred.

As shown in FIG. 3, the particles 18 have a thickness (length), T, and the matrix thickness W is about 50–90 percent of the particle thickness T. Silicon carbide particles of No. 35–40 U.S. Sieve Series Size (nominally 0.42–0.50 mm) have been found useful in the practice of the invention; up to U.S. Pat. No. 20 (0.83 mm) size also appears useful.

FIGS. 4–8 show how the particulates 18 are laid on the blade tip surface 11 where they will be subsequently permanently adhered. Prior to placing the silicon carbide particulates on the surface 11, they are first coated with about 0.010 mm of vapor deposited alumina according to the aforementioned Johnson et al patent, and then clad with a layer of metal, such as vapor or electrodeposited nickel, to a thickness of about 0.002–0.050 mm. Procedures for applying nickel coatings to ceramic particulates are commercially available and also are revealed in U.S. Pat. Nos. 3,920,410, 4,291,089 and 4,374,173. If the ceramic particulate material is inherently resistant to reaction with the matrix material then the alumina coating is not necessary. (Neither the alumina coating nor metal cladding are shown in the Figures.)

Just before the particles 18 are laid on the surface of the blade tip 11, a polymer adhesive 48 which is capable of being volatilized at less than about 540° C. is applied to the surface 11. The purpose of the adhesive 48 is to hold the abrasive particles 18 in place after they are deposited on the blade tip 11. A 1–20 volume percent polystyrene in toluene solution is preferred.

As noted above, the particles 18 in the abrasive layer 10 should be densely arranged on the blade tip 11 in a uniformly spaced apart pattern. As shown in FIGS. 4–8, to deposit the particles 18 in such a manner, a vacuum (suction) is drawn through a transfer tool having a plurality of apertures which are arranged to correspond with the desired, spaced apart pattern of particles on a blade tip. As is shown in FIG. 8, which shows the preferred means for depositing the particles, the apertures are perforations 44 in a rigid plate 42. The size of each perforation 44 or aperture is such that when the plate 42 is brought near a source of the particles 18, the vacuum draws the particles 18 against the plate 42, and only one particle 18 is held over each aperture. While not shown in the Figures, some particles 18 may be attracted to the plate 42 or to other particles 18 by, e.g., electrostatic forces, rather than held thereto by the vacuum. Such excess particles are dislodged from the plate 42 by gently tapping the plate 42, taking care not to dislodge the particles 18 held by the vacuum. The perforations 44 are particularly dimensioned relative to the particle size. The diameter of each perforation 44 must be large enough such that the force of the vacuum is sufficient to draw the particles 18 against the plate 42. At the same time, the perforations 44 must be small enough to prevent the particles 18 from passing therethrough. Preferably, the diameter of each perforation 44 is about $\frac{3}{4}$ of the particle size.

As is seen in FIG. 8, the area of the plate 42 covered by the particles 18 is slightly larger than the actual blade tip surface 11. This is accomplished by constructing the container 46, which holds the loosely lying particles, in the shape of an oversized blade tip; once the plate 42 is brought near the container and the vacuum turned on, the particles 18 will be attracted to the plate 42 in the pattern shown in FIG. 8. Preferably, the base 49 of the container 46 is a screen or mesh type material.

Once the particles 18 are securely held by the vacuum to the plate 42 as shown in FIGS. 5 and 8, the plate 42 is positioned over the blade tip 11 so that the perforations 44 (and the particles 18 overlying them) are aligned with the desired position of the particles 18 on the blade tip 11, as shown in FIG. 8. As noted above, the tip 11 is coated with a layer 48 of adhesive. Once the plate 42 is properly positioned over the blade tip 11, the vacuum level is adjusted so that the particles 18 drop onto the adhesive coated tip 11 (FIG. 7). The distance A between the particles 18 and the tip 11 should be minimized so that when the particles 18 are released from the plate 42, they do not bounce off of the tip 11, or stray significantly from their intended position on the tip 11.

Of course, when the particles 18 are released from the plate 42, it is possible that a few particles 18 will stray from the spaced apart relation they had when held to the plate 42, and as a result, there may be some slight agglomeration of particles 18 on the blade tip 11. Also, when the vacuum is drawn on the plate, it is possible that not every perforation 44 will be overlaid by a particle 18. However, use of the plate 42 as described above allows the deposition of a single layer of generally spaced apart particles 18 on the tip surface 11, in sufficient densities (i.e., particles per $cm^2$) required for turbine blade tip applications. While interparticle contact on the blade tip surface 11 is undesired, experience has shown that there are typically only a few particles 18 (less than about 15%), which touch each other.

After the particles 18 are deposited on the blade tip surface 11, the blade 14 is heated to volatilize the adhesive 48, which also causes solid state bonding (sintering) of the metal cladding to the tip surface 11. For nickel clad particles, the heat treatment is preferably carried out at about 1080° C. for 2 hours, in a vacuum or inert gas atmosphere. Use of such a protective atmosphere precludes oxidation of the cladding and blade tip 11.

Next, the particles 18 are oversprayed with a layer of matrix material 16 deposited by plasma arc spraying to a thickness T' as shown in FIG. 9. A nickel base superalloy of the type generally described in the aforementioned Johnson et al patent may be used. The preferred matrix composition is, by weight percent, about 25 Cr, 8 W, 4 Ta, 6 Al, 1.0 Hf, 0.1 Y, 0.23 C, balance Ni. The blade 14 is positioned with respect to the plasma arc device so that the tip cross section is generally perpendicular to the axis along which the molten matrix particles travel. The blade 14 is suitably masked around its periphery so that errant spray does not deposit on the sides of the blade 14. The matrix material 16 is applied to a thickness of about 0.6–1.3 mm, preferably 1.1–1.3 mm.

Although the sprayed layer of matrix material 16 will have about 95 percent theoretical density, it will nonetheless be characterized by some porosity or voids. The voids are characteristic of the metal spraying process, and would be produced by any such "line of sight" deposition process. Metal spraying is used because it is one of the few processes capable of applying a superalloy, with all its diverse constituents. Another process that may be used is a physical vapor deposition process, since such process has been shown to be capable of applying MCrAlY coatings and the like. See U.S. Pat. No. 4,153,005 to Norton et al.

Next, the blade 14 is subjected to a hot isostatic pressing procedure. Generally, this comprises deforming the matrix material 16 beyond its yield or creep-limit point at an elevated temperature. Preferably, the part is subjected to argon pressure while at elevated temperature, to close the aforementioned pores and voids, and to enhance the bond between the matrix 16, particles 18, and blade tip 11. For the specific superalloy matrix material described above, a temperature of about 1,100° C. and a gas pressure of about 138 MPa applied for two hours is sufficient. Other hot pressing procedures may be used to consolidate the matrix material 16 and achieve the object of densification and bonding.

Next, the rough surface of the abrasive layer 10, as shown in FIG. 9, is machined using a conventional procedure such as grinding to produce a smooth, planar suface, as shown in FIG. 10. After the machining process, the thickness of abrasive particles 18 and matrix material 16 is T. Finally, the surface of the abrasive layer 10 is contacted with an etchant or other substance which will attack and remove some of the matrix material 16, causing the particles 18 to project into space. For example, electrochemical machining can be used, as is described in U.S. Pat. No. 4,522,692 to Joslin. This step reduces the matrix thickness to a dimension W, which is about 50–90 percent of the dimension T, and results in the shape schematically shown in Fig. 3.

While FIGS. 4–8 show the preferred embodiment of the invention, i.e., the use of a perforated plate 42 to deposit the particles 18 on the blade tip 11, the apertures in the transfer tool may be defined by other means. One arrangement within the scope of the invention are hollow cylinders such as tubes or needles, which are spaced apart relative to each other such that the apertures (the cylinder ends) are arranged in the same pattern as the perforations in the plate. When a vacuum is drawn through the cylinders, only one particle will overlie each cylinder end. The particles are dropped from the cylinders in the same manner as they are dropped from the plate, as described above.

It has been found that there is a criticality in the aspect ratio of the particles 18, relevant to obtaining an abrasive layer 10 which contains a high density of uniformly spaced apart particles 18. When the particles are long and thin (i.e., have a high aspect ratio), they will of course tend to lie on their sides either when laid on the blade tip surface 11 initially or in the interval between the volatilization of the adhesive agent and the attainment of a metallic bond. Such laying-at-length disrupts the uniformity of placement and causes undue interparticle contact. Thus, the invention is best practiced when the aspect ratio of the particulates is less than about 1.9 to 1 and preferably is about 1.5 to 1 or less. The aspect ratio is defined herein as the average ratio of the longest particle dimension to the cross sectional dimension, as such is measured on a Quantimet Surface Analyzer (Cambridge Instruments, Cambridge, England).

The present invention is especially useful in providing a more effective abrasive layer (after the matrix is partially chemically milled away) compared to abrasive layers of the prior art. Suppose abrasive layers having the same volume percent of identically sized and shaped particles are made, first using the invention technique and second, using the prior art powder metal technique, as represented in FIG. 2. The area of abrasive particulate exposed at the surface of the invention and prior art layers, after the grinding operation, will be approximately the same. But the particulate deposited according to the invention will be distributed considerably more uniformly. And when the matrix is partially removed from the invention abrasive layer by electrochemical machining, about the same amount of surface area will be exposed on each particle, and the particles will all be about equally well-bonded to the blade tip. In contrast, owing to the non-uniform distribution of particles in prior art structures, when the matrix is electrochemically machined, those particles which were mostly contained in the matrix which is removed will of course be lost. The net result is that there will be less area of abrasive particles remaining at the free surface, and the prior art abrasive layer will be less effective in wearing the ceramic seal it rubs during engine operation.

While in the preferred embodiment of the invention the abrasive particles are placed in a uniform distribution on the blade tip, applications are contemplated in which there need be a greater or lesser concentration of particles at one or another portion of the tip. To achieve such a distribution of particles, the pattern of perforations in the plate is modified accordingly.

Although this invention has been shown and described with respect to a preferred embodiment, it will be understood by those skilled in the art that various changes in form and detail thereof may be made without departing from the spirit and scope of the claimed invention.

We claim:

1. A method for depositing a single layer of particles on the surface of an article, wherein the particles are spaced apart from each other on said surface in substantially noncontacting relation in a desired pattern, comprising the steps of:

(a) drawing a suction through transfer tool means having a plurality of apertures spaced apart from each other in said desired pattern while the tool means is adjacent to a container of the particles, wherein the suction holds one particle over each aperture.

(b) applying and adhesive to the surface of the article, (c) positioning the article relative to the apertures such that each particle substantially overlies its desired location on the article surface; and (d) adjusting the suction such that the particles are released from the tool means and drop onto the article surface to form said desired pattern, wherein the particles are held to the article surface by the adhesive.

2. The method of claim 1, wherein the particles are metal clad ceramic, and further comprising the step of heating the article having the particles thereon to an elevated temperature to remove the adhesive and to bond the particles to the article surface.

3. The method of claim 1, wherein between about 35–110 particles per $cm^2$ are deposited on the article surface, the particle size being between about Nos. 20 and 40 U.S. Sieve Series.

4. The method of claim 3 wherein the aspect ratio of the particles is less than about 1.9:1.

5. The method of claim 1, wherein the article is a blade for a gas turbine engine, and the layer of particles forms an abrasive coating on the surface of the blade.

6. A method for depositing a single layer of particles on the tip surface of a turbine blade, wherein the particles are spaced apart from each other on said tip surface in substantially noncontacting relation in a desired pattern, comprising the steps of:

(a) drawing a suction through transfer tool means having a plurality of apertures spaced apart from each other in said desired pattern while said tool means is adjacent to a container of the particles, wherein the suction holds one particle over each aperture;

(b) positioning the blade tip relative to the apertures such that each particle substantially overlies its desired location on the blade tip surface;

(c) adjusting the suction level through the tool means such that the particles drop onto the blade tip surface to form said desired pattern;

(d) depositing on the blade tip surface article a layer of matrix material to fill in the spaces between the particles; and (e) removing a portion of the matrix material such that the thickness of the matrix material is less than the thickness of the particles.

7. A method for depositing a single layer of abrasive particles in spaced apart relation to each other on an adhesive coated tip surface of a gas turbine engine blade, comprising the steps of holding a particle over each aperture of a transfer tool having a plurality of apertures therein by a suction drawn through the tool while the tool is disposed over the blade tip surface, and adjusting the suction so that the particles fall onto the adhesive coated tip surface and remain on the surface in substantially the same spaced apart relation that they were held to the transfer tool.

* * * * *